US006345959B1

(12) United States Patent
Spurry

(10) Patent No.: US 6,345,959 B1
(45) Date of Patent: Feb. 12, 2002

(54) PUMP WITH INTEGRAL PILOT OPERATED PRIORITY PRESSURE REGULATING VALVE

(75) Inventor: Roderick Howell Spurry, Wiltshire (GB)

(73) Assignee: Sauer-Danfoss (Swindon) Limited (GB)

( * ) Notice: Subject to any disclaimer, the term of this patent is extended or adjusted under 35 U.S.C. 154(b) by 0 days.

(21) Appl. No.: 09/640,597

(22) Filed: Aug. 17, 2000

(51) Int. Cl.[7] ..... F15B 13/00
(52) U.S. Cl. ..... 417/297; 91/516; 137/101
(58) Field of Search ..... 417/297, 442; 91/516; 60/422; 137/101, 118.06

(56) References Cited

U.S. PATENT DOCUMENTS

| | | | | |
|---|---|---|---|---|
| 3,979,908 A | * | 9/1976 | Alderson | 60/422 |
| 4,541,451 A | * | 9/1985 | Wittren et al. | 137/118 |
| 5,069,111 A | * | 12/1991 | Loffler et al. | 91/516 |

FOREIGN PATENT DOCUMENTS

| | | |
|---|---|---|
| GB | 1 309 162 | 3/1973 |
| GB | 1 545 071 | 5/1979 |
| GB | 2 294 527 | 6/1996 |
| GB | 2 306 926 | 5/1997 |

* cited by examiner

*Primary Examiner*—Charles G. Freay
(74) *Attorney, Agent, or Firm*—Zarley, McKee, Thomte, Voorhees & Sease, P.L.C.

(57) ABSTRACT

A fluid pump has a housing (4), a main output port (10), an auxiliary output port (14) and a priority pressure regulating valve contained with the housing (4). The priority pressure regulating valve has a spool (20) to direct fluid to one or both of the of the output ports (10,14), a force means (34,36) associated with the spool to bias the spool (20) to a position where it causes fluid to flow to the main output port (10) exclusively, and a pressure release means (40) which enables the spool (20) to move to a position where it permits fluid to flow to the auxiliary output port (14) when the pressure at the main output port (10) is at or greater than a predetermined pressure.

11 Claims, 3 Drawing Sheets

PUMP WITH INTEGRAL PILOT OPERATED PRIORITY PRESSURE REGULATING VALVE

BACKGROUND OF THE INVENTION

1. Field of the Invention

The invention relates to fluid pumps, and in particular to gear pumps and other positive displacement hydraulic pumps, which can be used to deliver hydraulic fluid to two different sets of hydraulic loads. A priority valve is needed to distinguish between the two loads, and deliver hydraulic fluid preferentially to a first load up to a first working pressure, and only then deliver hydraulic fluid to the second load which is a non-preferential load.

2. Description of the Related Art

Priority valves are known which divide the flow from a hydraulic pump into preferred and non-preferred flows for servicing two loads as indicated above. The majority of such priority valves have been connected in series with the pump output, being connected to the pump by conduits and to the first and second loads by further conduits.

In GB 2298902, the present Applicant discloses a pump incorporating an integral priority pressure regulating valve. The valve is spring biased at one end face in a direction to permit fluid communication between a high pressure chamber of the pump and a main port connected to the preferential load only. An opposing end face of the valve is supplied with hydraulic fluid from the main port in such a manner to counter the spring bias. When the main port receives hydraulic fluid of a predetermined pressure, the pressure on the opposing end face is sufficient to overcome both the compressive force developed by the spring and the static friction associated with the valve, thereby enabling the movement of the valve to a position where it permits fluid communication between the high pressure chamber and an auxiliary port which is connected to the non-preferential load. This pump is much simpler to install than one requiring a separate priority pressure regulating valve to be inserted in the pipeline or conduit between the pump and the main and auxiliary loads, and there is a much lesser tendency for fluid leakage.

In this arrangement, the spring provided to bias the valve must be of sufficient strength so as to meet the total reaction developed against it when fluid of the predetermined pressure is applied to the non-spring end face of the valve. Quite often, the predetermined pressure selected is relatively high and hence the loading on the spring can be excessive.

The characteristics of the spring are extremely important since the spring must be compressed to a depth equal to the length through which the valve is require to travel without exhibiting substantial changes in its reaction against the valve, otherwise the reaction developed by the spring against the valve will increase significantly as the spring is compressed.

Furthermore, whereas pressure is uniformly applied to the non-spring end face of the valve from the main port, the force exerted by the spring on the valve is localized through the points of contact between the spring and the valve. This may induce distortion of the valve profile.

Additionally, as the spring is an integral component to the pump, it is a relatively difficult operation to adjust or replace the spring so as to provide the pump with a new predetermined pressure setting.

Therefore, it is an objective of the present invention to significantly reduce the problems identified above in relation to the prior art. This is achieved by means of pilot operation.

BRIEF SUMMARY OF THE INVENTION

The invention provides a fluid pump having a housing, a main output port, an auxiliary output port and a priority pressure regulating valve contained within the pump housing. The priority pressure regulating valve includes a spool having two opposing end faces. Each of these end faces is disposed within a chamber which is in fluid communication with the main output port. A force means is also included in association with one of the spool end faces to bias the spool to a position where it causes fluid developed by the pump to flow to the main output port exclusively. A pressure release means is provided in fluid communication with one of the chambers to enable fluid to flow from said one of the chambers when the pressure at the main output port is at a predetermined working pressure thereby establishing a pressure differential across the two end faces of the spool which is sufficient to overcome the bias developed by the force means thus causing the spool to move to a position where it permits fluid developed by the pump to flow to the auxiliary output port.

In a preferred embodiment, that chamber which is in fluid communication with the pressure release means houses the force means. In this arrangement, the force means is preferably a coil spring in compression.

Alternatively, the force means may be provided in the chamber which is remote from that which is in fluid communication with the pressure release means. In these circumstances, the force means may be a coil spring in tension.

Preferably, the pressure release means includes a poppet, a regulating spring and an adjuster, wherein one face of the poppet is in fluid communication with one of the chambers and the regulating spring is disposed to resist the force exerted on the face of the poppet by the pressurized fluid contained in said chamber. The poppet may be located between said chamber and a channel such that when the pressure exerted on the poppet by the fluid in said chamber overcomes the opposing force exerted on the poppet by the regulating spring, fluid communication is established between said chamber and the channel.

In a preferred embodiment of the invention, the channel drains to an inlet of the pump.

The regulating spring may be a helical spring in compression which engages that face of the poppet which opposes the face which is in fluid communication with said chamber. Additionally, that end of the regulating spring which is remote from the poppet may abut the adjuster in a manner such that the adjuster can be moved along the axis of the regulating spring to adjust the compressive force exerted on the poppet by the regulating spring.

DETAILED DESCRIPTION OF THE INVENTION

Figure 1:
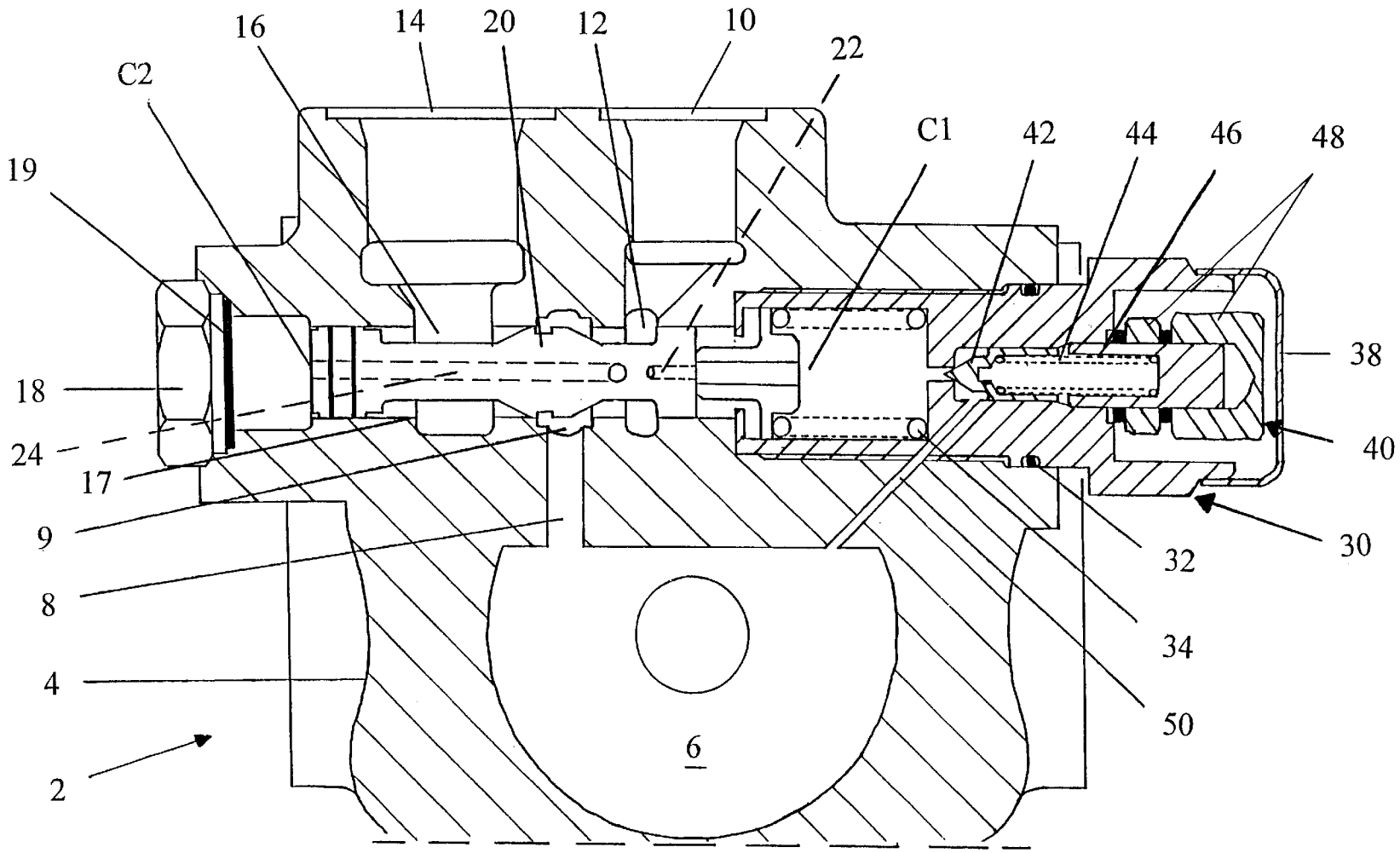
FIG. 1 is a transverse section through a gear pump according to the invention, taken along the axis of the priority pressure regulating valve of the pump, showing a spool of the valve in a position in which it delivers hydraulic output fluid to a main or priority outlet port at a pressure below a predetermined level.

FIG. 1 illustrates a gear pump 2 according to a preferred embodiment of the invention. The pump 2 has a housing 4 within which is disposed the pumping elements 6 of the pump 2, an accurately machined bore 17, a priority outlet port 10 and an auxiliary outlet port 14. The housing 4 and pumping elements 6 can be of types as used in relation to any conventional positive displacement hydraulic fluid pumps.

As shown in FIG. 1, the bore 17 extends throughout the entire transverse length of the pump 2 and is hydraulically sealed at either end. On the left, the seal is achieved by a washer 19 which is mounted over a threaded bolt 18 in a conventional manner. The threaded portion of the bolt 18 engages with threads provided on the circumferential wall of the bore 17. On the right, the seal is achieved by an O-ring seal 32 disposed on a screw end cap 30 which also is removably engaged with the housing 4.

High pressure fluid developed by the pumping elements 6 is delivered through a supply channel 8 in the housing 4 to a supply annulus 9 machined into the wall of the bore 17. A spool 20 is provided within the bore 17 and is capable of axial movement along the length of the bore 17. Depending on its position, the spool 20 is capable of permitting high pressure fluid to flow from the supply annulus 9 to one or both of a first 12 and a second 16 output annulus provided on the wall of the bore 17. The first output annulus 12 communicates directly with the priority outlet port 10, while the second output annulus 16 communicates directly with the auxiliary outlet port 14.

A first orifice and blind axial drilling 2.2 and a second orifice and blind axial drilling 24 are provided in the spool 20. These are constantly in fluid communication with the priority outlet port 10. The first blind drilling 22 delivers fluid to the right hand end face of the spool 20. The second blind drilling 24 delivers fluid to the left hand end face of the spool 20 where it communicates with a second pressure chamber C2 defined by the wall of the bore 17, the threaded bolt 18 and the left hand end face of the spool 20.

The screw end cap 30 has a first pressure chamber C1 which contains a frictional spring 34. This is a compressed helical spring which, during operation, is used to bias the spool 20 to the left as shown in FIG.1. The frictional spring 34 is mounted on a cylindrical spring carrier 36 (shown in FIG.2). The spring carrier 36 extends from the screw end cap 30 into the bore 17 so as to abut the right hand end face of the spool 20. The spring carrier 36 has an axial channel to permit fluid communication between the first orifice and blind drilling 22 and the first pressure chamber C1. As such, the spool 20, through the spring carrier 36, is biased by the frictional spring 34 to the left end of the bore 17.

In addition to the first pressure chamber C1, the screw end cap 30 also houses a pilot 40. The pilot 40 consists of a poppet 42, a regulating spring 44, a threaded adjuster 46 and two lock nuts 48. The regulating spring 44 is in compression and biases the poppet 42 to the left.

Depending upon the pressure of the hydraulic fluid in the first pressure chamber C1 and the biasing force exerted by the regulating spring 44, the poppet 42 can prevent or permit fluid to flow from the first pressure chamber C1 through a drain channel 50 to a tank or, preferably, to an inlet of the pumping elements 6. Once the pressure of the fluid in the first pressure chamber C1 is sufficient to overcome the opposing compressive force developed by the regulating spring 44, the poppet 42 lifts against the spring 44 and thereby allows fluid to flow from the first pressure chamber C1 to the drain channel 50. The screw end cap 30 is provided with a removable plate 38 which enables the user to access the lock nuts 48 and the threaded adjuster 36. By rotating the threaded adjuster 36, the user changes the compressive force exerted by the regulating spring 44 on the poppet 46, and hence changes the predetermined pressure setting at with the poppet 42 lifts.

In comparison to the pump disclosed in GB 2298902, the regulating spring 44 of the present invention can be made substantially stiffer since it is only compressed slightly and is not required to be compressed to the extent to which the spool moves along the bore as in the prior art. Indeed, the regulating spring 44 is only required to generate relatively low loads compared with the single spring design of the prior art. Additionally, in the prior art pump, when the predetermined pressure is established, the spool commences to compress the regulating spring but as the spring is compressed the reaction that it exerts on the spool progressively increases and therefore the pressure required to counteract the spring's reaction is required to increase. Hence, as the spool traverses along the bore the predetermined pressure changes. In the present invention, use of the regulating spring 44 in the pilot 40 gives a more definite predetermined pressure throughout operation as it is used to counteract the pressure only and not the movement of the spool 20.

In the present embodiment, on start-up, and at all other instances when the pressure of the fluid developed by the pumping elements 6 is less than the predetermined pressure, the spool 20 is biased to the position as shown in FIG. 1 by the frictional spring 34. Thus, fluid in the supply annulus 9 is delivered initially past a first land 26 (see FIG.2) to the first output annulus 12 which communicates with the priority outlet port 10. At this stage a second land 28 (FIG.2) provided on the spool 20 blocks hydraulic flow to the auxiliary output port 14. The pressure of the fluid at the priority outlet port 10 is communicated to the first and second pressure chambers C1,C2 by the respective orifices and blind drillings 22,24. Since the pressure of the fluid is not sufficient to lift the poppet 42 of the pilot 40 against the regulating spring 44, the spool 20 is pressure balanced across its end faces and the frictional spring 34 exerts a slight force on the spool 20 through the spring carrier 36 ensuring that the spool 20 remains in the same position to the left of the bore 17.

Figure 2:
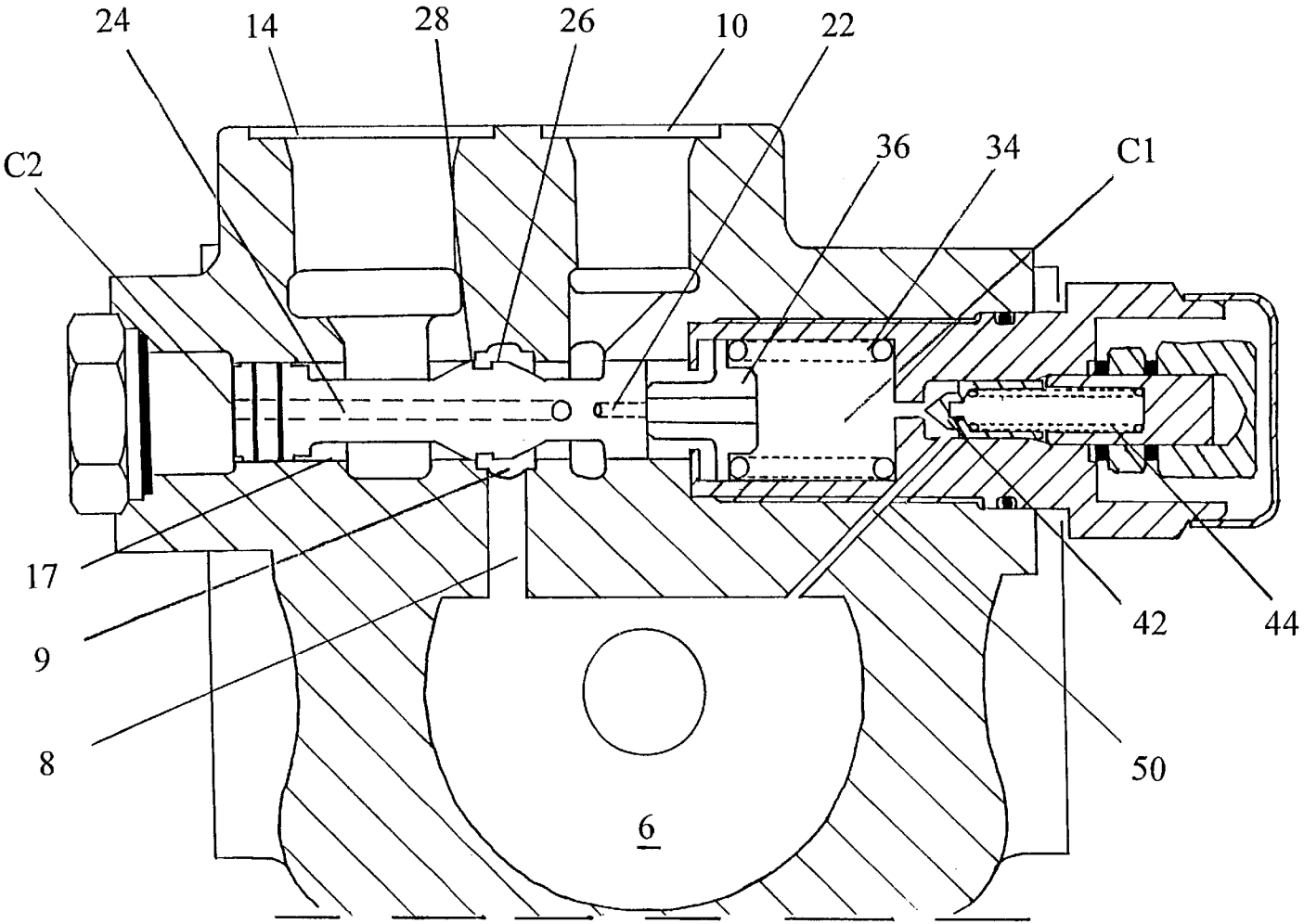
FIG. 2 shows the pump of FIG. 1 in a condition wherein the pressure of the hydraulic fluid developed by the pump just equals the predetermined pressure required at the main or priority outlet port.

In FIG. 2, the pressure of the fluid developed by the pumping elements 6 has just reached the predetermined level. Under these conditions, the pressure of the fluid at the priority outlet port 10, in the first pressure chamber C1 and in the second pressure chamber C2 is at the predetermined pressure. Therefore, the pressure of the fluid in the first pressure chamber C1 is sufficient to lift the poppet 42 against the regulating spring 44 and fluid is allowed to flow from the first pressure chamber C1 through the drain channel 50 to the inlet of the pumping elements 6. This produces a pressure drop in the first pressure chamber, and thereby a pressure differential is established across the two end faces of the spool 20. The differential is more than sufficient to overcome the slight reaction exerted by the frictional spring 34 and hence the spool 20 moves to the right enabling fluid in the supply annulus 9 to be communicated to the auxiliary outlet port 14 as well as the priority outlet port 10.

Figure 3:
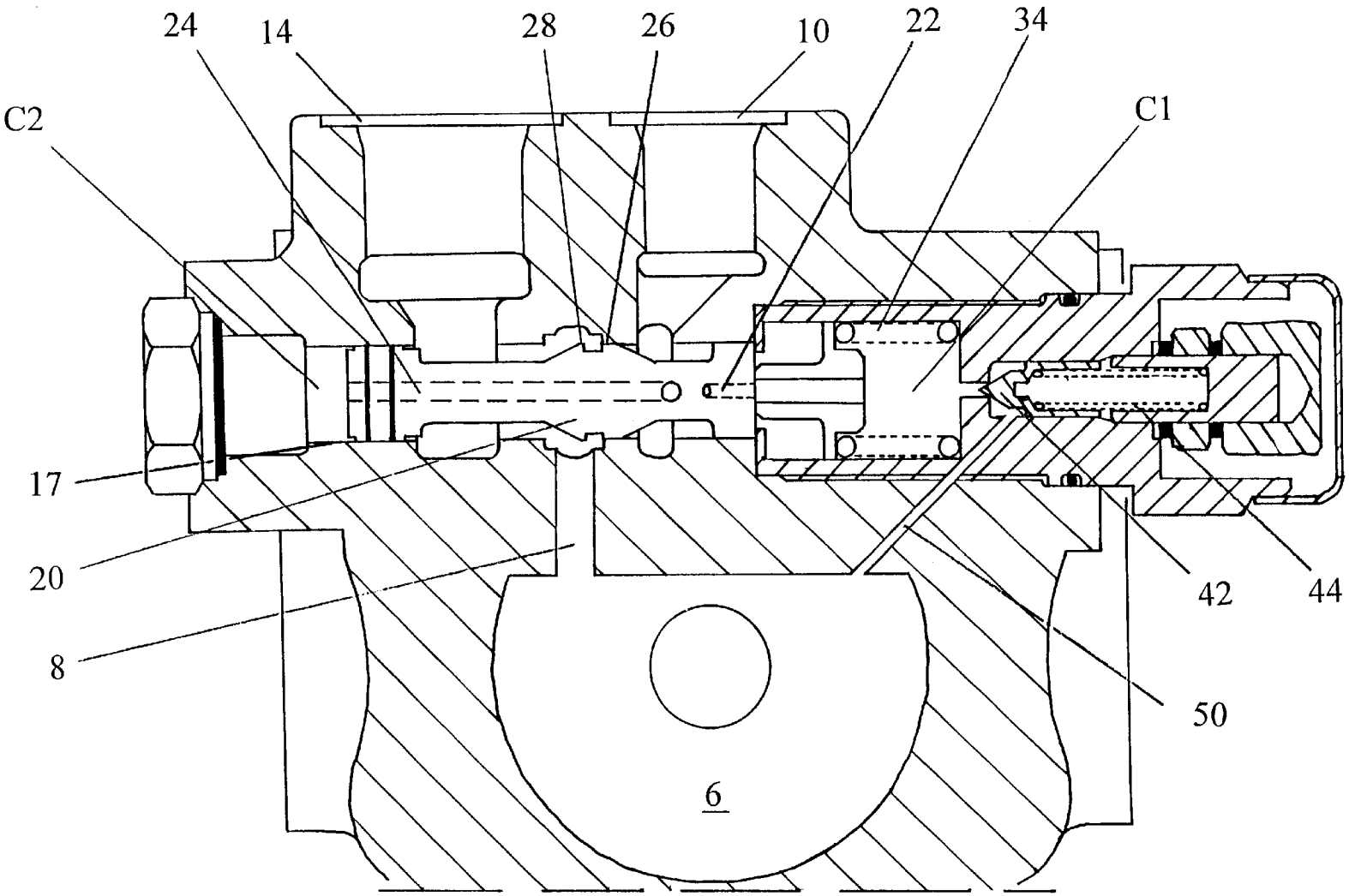
FIG. 3 shows the pump of FIG. 1 in a condition wherein the pressure of the hydraulic fluid at the main or priority outlet port has just been reduced to a level slightly less than the predetermined pressure.

If the pressure of the fluid developed by the pumping elements 6 continues to be maintained at or above the predetermined level, the spool 20 continues to move until it reaches the extreme right hand position as shown in FIG. 3 in which a shoulder portion of the spool 20 abuts a stop washer that is retained in position by the screw end cap 30.

In this position, fluid communication between the supply annulus 9 and the priority outlet port 10 is interrupted by the first land 26 provided on the spool 20, and fluid communication is exclusively established between the supply annulus 9 and the auxiliary outlet port 14. If at this instance, the pressure at the priority outlet port 10 is greater than the predetermined level, the excess fluid is permitted to flow from the priority outlet port 10 through the first orifice and blind axial drilling 22, through the channel provided in the spring carrier 36 and through the first pressure chamber C1 to the drain channel 50. Thereby the pressure at the priority outlet port 10 is reduced until the predetermined level is achieved, at which point the poppet 42 blocks fluid from flowing from the first pressure chamber C1 to the drain channel 50 (as shown in FIG.3). This establishes a pressure balance across the respective end faces of the spool 20 and the frictional spring 34 moves the spool 20 back to the left. If the pressure of the fluid developed by the pumping elements 6 is still greater than the predetermined level, the spool 20 moves back to the right, otherwise it moves to the position shown in FIGS. 1 and 2.

Thus the spool 20 preferentially feeds the priority outlet port 10 with a regulated pressure supply. When the supply is satisfied so that the pressure in the priority outlet port 10 reaches a predetermined working pressure, the spool 20 moves so that hydraulic fluid delivered by the pump 2 continues to be delivered, but to the auxiliary outlet port 14 rather than exclusively to the priority outlet port 10.

The pressure at the auxiliary outlet port 14 can be greater than or less that the pressure at the priority outlet port 10. If the predetermined working pressure, which is the pressure required at the priority outlet port 10, is less than the working pressure at the auxiliary outlet port 14 the latter pressure can be allowed to rise until it reaches a maximum rated output pressure of the pump 2. Alternatively, the working pressure at the auxiliary outlet port 14 can be limited by a pressure relief valve (not shown in the drawings) with excess hydraulic fluid being returned to drain.

What is claimed is:

1. A fluid pump having a housing, a main output port, an auxiliary output port and a priority pressure regulating valve contained within the housing, wherein the priority pressure regulating valve comprises:

a spool having two opposing end faces, each end face being disposed within a chamber which is in fluid communication with the main output port;

a force means associated with one of the spool end faces to bias the spool to a position where it causes fluid developed by the pump to flow to the main output port exclusively; and a pressure release means in fluid communication with one of the chambers which enables fluid to flow from said one of the chambers when the pressure at the main output port is at least equal to a predetermined working pressure thereby establishing a pressure differential across the two end faces of the spool which is sufficient to overcome the bias developed by the force means thus causing the spool to move to a position where it permits fluid developed by the pump to flow to the auxiliary output port.

2. A fluid pump according to claim 1, wherein the chamber in fluid communication with the pressure release means houses the force means.

3. A fluid pump according to claim 2, wherein the force means is a coil spring under compression.

4. A fluid pump according to claim 1, wherein force means is housed in the chamber which is remote from that which is in fluid communication with the pressure release means.

5. A fluid pump according to claim 4, wherein the force means is a coil spring under tension.

6. A fluid pump according to claim 1, wherein the spool is provided with one or more axial fluid channels and one or more orifices to enable fluid communication between the main output port and the chambers.

7. A fluid pump according to claim 1, wherein the pressure release means comprises a poppet, a regulating spring and an adjuster, wherein one face of the poppet is in fluid communication with said one of the chambers and the regulating spring is disposed to resist the force exerted on the face of the poppet by the pressurized fluid in said one of the chambers.

8. A fluid pump according to claim 7, wherein the poppet is disposed between said one of the chambers and a channel such that when the pressure exerted on the poppet by the fluid in said one of the chambers overcomes the opposing force exerted on the poppet by the regulating spring, fluid communication is established between said one of the chambers and the channel.

9. A fluid pump according to claim 8, wherein the channel drains to an inlet of the pump.

10. A fluid pump according to claim 7, wherein the regulating spring is a helical spring in compression and engages that face of the poppet which opposes the face which is in fluid communication with said one of the chambers.

11. A fluid pump according to claim 10, wherein that end of the regulating spring which is remote from the poppet abuts the adjuster and the adjuster can be moved along an axis of the regulating spring to adjust the compressive force exerted on the poppet by the regulating spring.

* * * * *